United States Patent [19]

Johnson

[11] Patent Number: 5,022,154

[45] Date of Patent: Jun. 11, 1991

[54] REAPER RAZOR

[76] Inventor: Wayne A. Johnson, P.O. Box 3400, Corpus Christi, Tex. 78463

[21] Appl. No.: 591,043

[22] Filed: Oct. 1, 1990

[51] Int. Cl.[5] ..... B26B 19/42

[52] U.S. Cl. ..... 30/34.2; 30/34.05

[58] Field of Search ..... 30/34.2, 34.05, 43, 30/90, 201, 233

[56] References Cited

U.S. PATENT DOCUMENTS

| | | | |
|---|---|---|---|
| 1,404,603 | 1/1922 | Gray | 30/34.2 X |
| 2,837,820 | 6/1958 | Ostrowski | 30/34.2 X |
| 3,327,387 | 6/1967 | Harr et al. | 30/34.2 |

FOREIGN PATENT DOCUMENTS

| | | | |
|---|---|---|---|
| 803641 | 4/1951 | Fed. Rep. of Germany | 30/34.2 |
| 460684 | 2/1937 | United Kingdom | 30/34.2 |

*Primary Examiner*—Douglas D. Watts

*Attorney, Agent, or Firm*—G. Turner Moller

[57] ABSTRACT

A reaper razor includes a blade having a sharpened edge and a reaper member rotatably drive adjacent the blade. The reaper member pushes hair to be cut against the sharpened edge severing the hair from its shank. The blade is mounted for adjustable movement toward and away from the reaper member to accommodate reaper wear. The reaper member is made of a rubber like material having a Shore durometer hardness of 55-70, a coefficient of kenetic friction of at least 0.8 and preferably above 1.0 and is electrostatically active.

11 Claims, 2 Drawing Sheets

REAPER RAZOR

This invention comprises an improved razor and, more specifically, to a razor incorporating a rotating reaper which pushes hair to be cut against a sharpened blade.

There are obviously many different types of razors. One type razor that has evidently escaped substantial development incorporates a rotating reaper member which pushes hair to be shaved against a sharpened blade. The earliest known razor of this type is found in U.S. Pat. No. 2,330,853. Upon reflection, there are a number of disadvantages or imperfections to this known razor.

For example, wear of the rotatable reaper and/or blade requires a new reaper or blade to be installed. In addition, a preferred material for the reaper member is relatively sticky, as opposed to slick, so any hair contacted by the reaper is more efficiently pushed against the sharpened blade. Furthermore, a preferred material for the reaper member generates an electrostatic charge to attract hair on the body of the user thereby causing the hair to stand up for more efficient cutting.

Other disclosures of interest are found in U.S. Pat. Nos. 1,777,691; 2,119,248; 2,229,971 and 2,711,015.

In the device of this invention, the blade is adjustably mounted relative to the reaper member so, upon noticeable wearing of either, the relative position of the blade relative to the reaper member can be changed. The blade is preferably of the "injector" type by which is meant that it is inserted into a blade holder along a path parallel to the cutting edge. To adjust the position of the blade relative to the reaper member, the blade holder is pivotably mounted on the razor housing and a threaded member connects to the blade holder at a location spaced from the pivot axis.

Although many materials are suitable, the preferred material for the reaper member is a relatively soft silicon rubber composition having a hardness of 55–70 on the Shore durometer. Such a material is relatively easy to mold or shape into the reaper member and also exhibits the desired electrostatic properties. Upon the proper surface treatment, this material provides the desired frictional characteristics.

In summary, one aspect of this invention comprises a razor including a housing having an electric motor therein, a blade having a straight sharpened edge, a reaper member having a body and plurality of blades projecting therefrom, means mounting the reaper member for rotation about an axis parallel to the blade edge, the axis being spaced from the blade a distance substantially equal to the length of the reaper blades as measured from the axis and means mounting the blade for adjustable movement toward and away from the axis of rotation.

In another aspect, this invention comprises a razor including a housing having an electric motor therein, a blade having a straight sharpened edge, a reaper member having a body and plurality of blades projecting therefrom, and means mounting the reaper member for rotation about an axis parallel to the blade edge, the axis being spaced from the blade a distance substantially equal to the length of the reaper blades as measured from the axis, the reaper member being made of an organic polymeric material having a coefficient of kinetic friction greater than about 0.8.

It is an object of this invention to provide an improved reaper type razor including means for adjustably mounting a blade for movement toward and away from the reaper.

A further object of this invention is to provide an improved reaper razor having a particular composition for the reaper member.

These and other objects of this invention will become more fully apparent as this description proceeds, reference being made to the accompanying drawing and appended claims.

IN THE DRAWINGS

Figure 1:
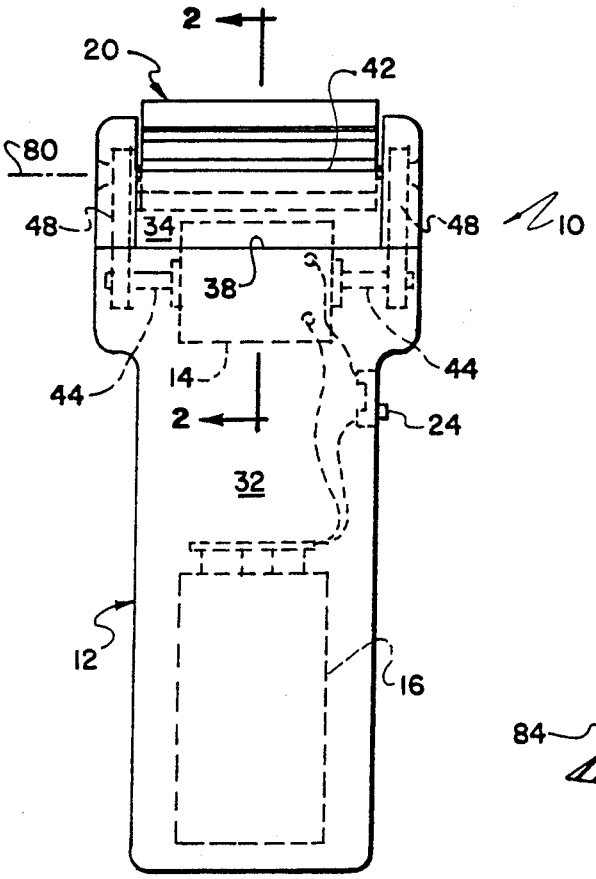
FIG. 1 is a front view of the reaper razor of this invention.
Figure 2:
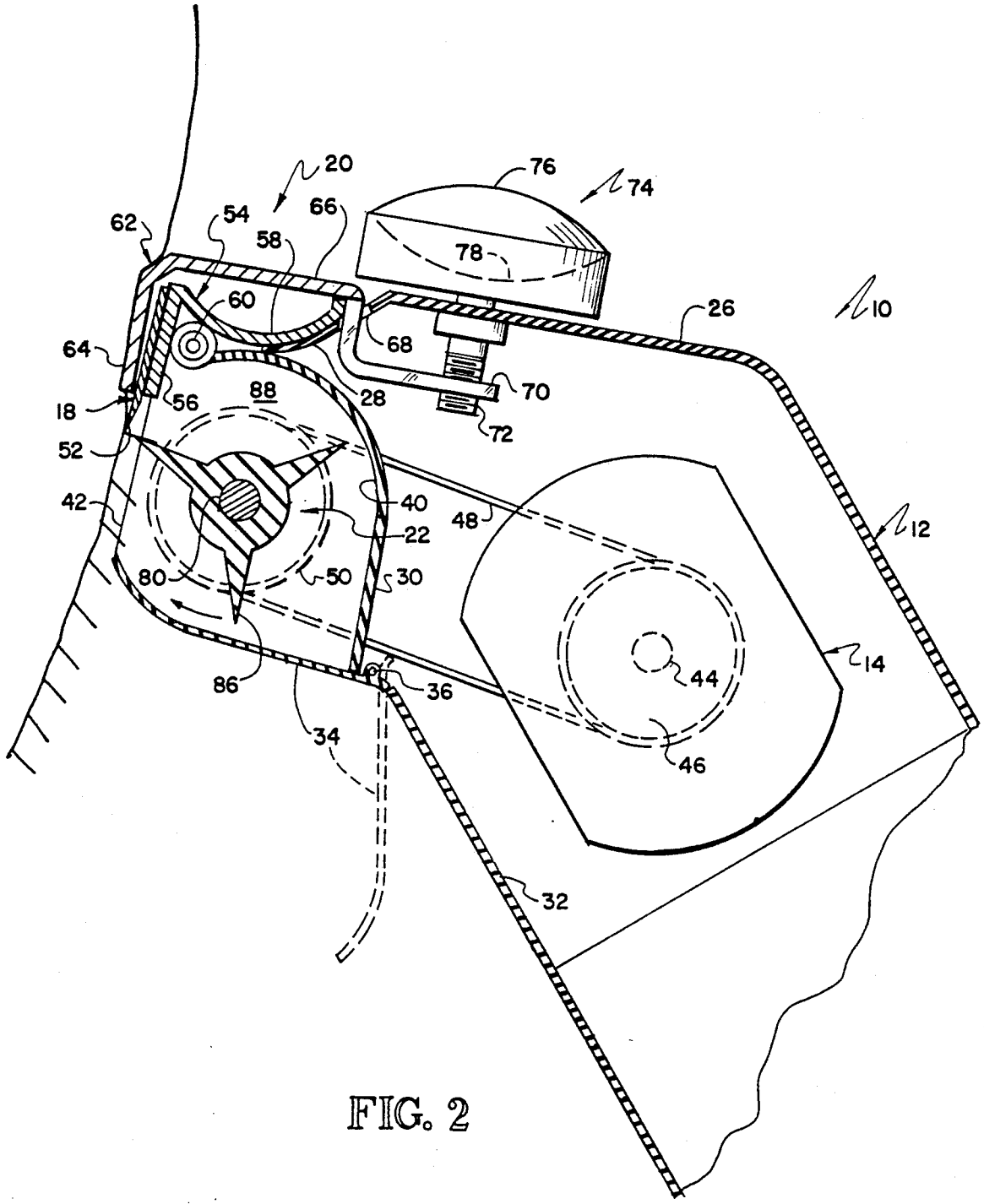
FIG. 2 is a longitudinal cross-sectional view of the razor of FIG. 1, taken substantially along line 2—2 thereof as viewed in the direction indicated by the arrows and illustrating the razor against the face of a user.

Referring to FIGS. 1 and 2, a razor 10 of this invention comprises, as major components, a housing 12, an electric motor 14 driven by a battery 16, a sharpened blade 18 and blade holding mechanism 20 and a reaper member 22 for pushing whiskers or hairs to be cut against the sharpened blade 18.

The housing 12 may be of any suitable size and shape and is conveniently made of an injection molded plastic. The battery 16 is conveniently carried by the housing 12 near the lower end thereof and may be of the rechargeable type through electrodes (not shown). A conventional on-off switch 24 is provided to control the motor 14. The housing 12 includes an inclined top wall 26 having a concave section 28 near the upper end thereof. A stubble shield 30 extends from adjacent the concave section 28 toward a front wall 32. An access door 34 is pivoted by a hinge 36 to the housing 12 to close an opening 38 on the front of the razor 10 and allow removal of stubble from a compartment 40 as suggested by the dashed lines in FIG. 2. With the access door 34 closed, an opening 42 is provided for the reaper member 22 as shown in FIG. 2.

The motor 14 may be of any suitable type and is illustrated as comprising a pair of coaxial output shafts 44 driving pulleys 46. A pair of endless belts 48 on the pulleys 46 extend outside the stubble shield 30 around a pair of driven pulleys 50 on the reaper member 22 as more fully pointed out hereinafter.

The blade 18 is preferably of the injector type having a sharpened edge 52 essentially tangential to the reaper member as pointed out more fully hereinafter. The blade holder 20 includes a first section 54 having a flat end 56 and a concave end 58. A hinge 60 in the bight between the ends 56, 58 mounts the blade holder section 54 for pivotal movement on the housing 12. The blade holder 20 also includes a second section 62 having a flat end 64 juxtaposed to the flat end 56 and converging slightly relative thereto toward the blade edge 52.

The second section 62 includes a transverse portion 66 extending over the concave end 58 and secured thereto. The transverse portion 66 extends through a slot 68 in the housing 12 and provides a fulcrum end 70 having a threaded opening (not shown) receiving a threaded shank 72 of a blade adjusting mechanism 74. The blade adjusting mechanism 74 includes a thumb wheel actuator 76 which may have a slot 78 therein to receive a screwdriver blade. When the reaper member 22 wears substantially, the actuator 76 may be turned slightly to tilt the blade holder 20 in a counterclockwise direction to advance the blade edge 52 toward the axis 80 of rotation of the reaper member 22.

The second blade holder section 62 is somewhat resilient so the flat end 64 is normally biased toward the flat end 56 to captivate the blade 18 therebetween. The blade 18 may be removed and replaced by a new blade by inserting the conventional injector blade cartridge adjacent one open end of the blade holding slot defined between the ends 56, 64 and manipulating the injector blade cartridge in a conventional manner.

Figure 3:
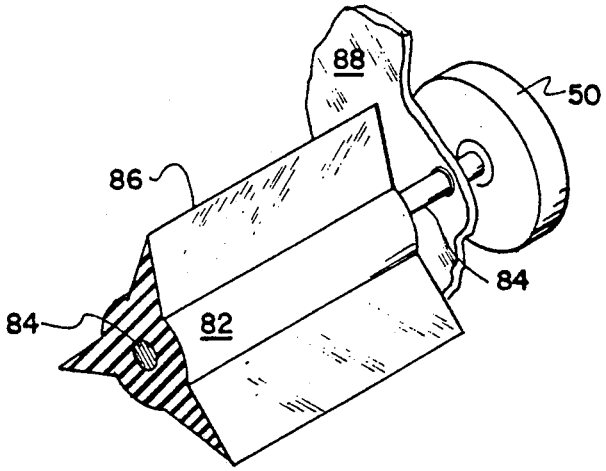
FIG. 3 is a broken isometric view of one embodiment of the reaper member of this invention.

The reaper member 22 is shown best in FIGS. 2 and 3 and comprises a cylindrical body 82 having a shaft 84 bonded thereto with the driven pulleys 50 being removably connected to the shaft 84. Preferably, the driven pulleys 50 are located behind walls 88 and sealed relative thereto to prevent stubble from reaching the interior of the housing 12. A series of reaper blades or paddles 86 extend radially away from the body 82 in any convenient arrangement. As illustrated, the three blades 86 are spaced at 120° intervals about the body 82 although it will be apparent that there may be as many blades 86 as desired, spaced at whatever intervals are desired.

The properties of the material from which the reaper member 22 is made are somewhat unusual. The reaper member 22 is made of a organic polymer such as polyethylene, polypropylene, acrylic, rubber or rubber like compositions which is preferably relatively soft, at least about 55 on a Shore durometer up to about 70. To promote propelling the hair to be cut against the blade 18, the reaper member 22 is somewhat sticky, as opposed to slick. It has been found that preferred materials have a coefficient of kinetic friction of at least about 0.8 and preferably above about 1.0. A tabulation of a number of rubber or rubber like materials made from samples in the form of a sheet is found in Table I.

TABLE I

| Material | Shore Durometer Hardness | Coefficient of Static Friction | Coefficient of Kinetic Friction |
|---|---|---|---|
| Neoprene | 66.0 | .91 | .82 |
| Neoprene II | 62.5 | .70 | .57 |
| Pure Gum | 46.5 | .99 | .81 |
| Red SBA | 84.0 | .79 | .65 |
| White Nitrile | 63.0 | .46 | .39 |
| EPDM | 58.5 | .48 | .41 |
| Silicone | 67.5 | 1.12 | 1.06 |
| Viton | 75.0 | .83 | .75 |

Viton is a relative expensive material and is a little hard. Red SBA is rather too hard. Pure gum rubber is a little soft. The coefficient of friction exhibited by these materials is, to a large extent, the result of the surface treatment of the material during manufacture. Being made in a smooth mold will normally result in a reaper that is relatively slick. The major difference between the silicone rubber sample tested and the remaining samples is that the silicone rubber had a finish known in the trade as a fabric finish whereas the remaining materials had an air finish. These terms result from the different curing treatment the sheet material received after being calendared. In curing rubber or rubber like materials, the partially cured sheets are either hung on racks to be air cured or placed between sheets of gauze like fabric to receive a fabric finish. Thus, in this invention, many different materials are suitable provided they are sufficiently soft and have the desired surface treatment to produce a relatively sticky surface as opposed to relatively slick one.

In addition, the reaper member 22 is a good insulator thereby being somewhat electrostatic during rotation against the blade 18.

Operation of the razor 10 should now be apparent. The user closes the switch 24 which starts the motor 14 thereby turning the driving pulleys 46 and moving the belts 48 to rotate the driven pulleys 50. The reaper member 22 rotates about its axis 80 so the blades 86 push whiskers to be cut against the sharpened edge 52 of the blade 18 whereupon they are severed from the hair shank. Stubble from the cutting operation collects in the compartment 40 and may periodically removed simply by opening the door 34. When the reaper member 22 wears to any extent, the thumb wheel actuator 76 may be turned to rotate the blade holder 20 thereby adjusting the relationship between the sharpened edge 52 and the reaper blades 86.

Figure 4:
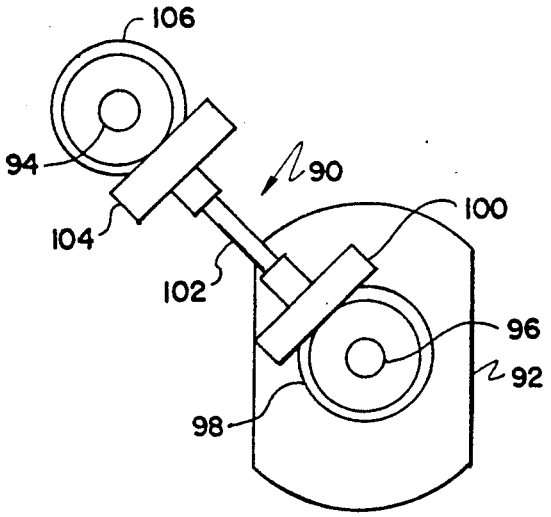
FIG. 4 is a partial schematic view of another embodiment of this invention.

Referring to FIG. 4, there is illustrated another embodiment of the reaper razor of this invention, illustrating a gear drive connection 90 between an electric motor 92 and a reaper shaft 94. The motor 92 includes an output shaft 96 having a drive gear 98. A gear 100 drives a shaft 102 having a gear 104 thereon in meshing engagement with a gear 106 on the reaper shaft 94.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A razor comprising a housing having an electric motor therein;

a blade having a straight sharpened edge;

a reaper member having a body and plurality of blades projecting therefrom;

means mounting the reaper member for rotation about an axis parallel to the blade edge, the axis being spaced from the blade a distance substantially equal to the length of the reaper blades as measured from the axis;

means drivably rotating the reaper member about the axis; and means mounting the blade for adjustable movement toward and away from the axis of rotation.

2. The razor of claim 1 wherein the reaper blades project radially from the reaper body.

3. The razor of claim 1 wherein the blade mounting means comprises a pair of elongate converging metal strips providing a first elongate slot therebetween through which the sharpened blade edge projects, the strips providing first and second end slots for passing the blade into, through and out of the blade mounting means.

4. The razor of claim 3 wherein the blade mounting means comprises means pivotally mounting a first of the metal strips on the housing, means connecting a second of the metal strips to the first strip and means for adjusting the position of the first and second strips relative to the housing.

5. The razor of claim 4 wherein the housing provides an upper wall having an opening therethrough and the adjusting means comprises a threaded member extending through the upper wall into engagement with one of the metal strips.

6. The razor of claim 1 wherein the reaper member is made of an organic polymeric material having a Shore durometer hardness of about 55–70 and a coefficient of kinetic friction greater than about 0.8.

7. The razor of claim 6 wherein the coefficient of kinetic friction is greater than 1.0.

8. A razor comprising a housing having an electric motor therein;

a blade having a straight sharpened edge;

a reaper member having a body and plurality of blades projecting therefrom; and means mounting the reaper member for rotation about an axis parallel to the blade edge, the axis being spaced from the blade a distance substantially equal to the length of the reaper blades as measured from the axis;

the reaper member being made of an organic polymeric material having a Shore durometer hardness of about 55–70 and a coefficient of kinetic friction greater than about 0.8.

9. The razor of claim 8 wherein the organic polymeric material has a fabric finish.

10. The razor of claim 9 wherein the organic polymeric material is silicone rubber.

11. The razor of claim 10 wherein the coefficient of kinetic friction is above about 1.0.

* * * * *